US005325166A

United States Patent [19]

Hamilton et al.

[11] Patent Number: 5,325,166

[45] Date of Patent: Jun. 28, 1994

[54] FUSER OVERHEAT CONTROL

[75] Inventors: Douglas C. Hamilton; David B. Langer; Phillip B. Wright, all of Lexington, Ky.

[73] Assignee: Lexmark International, Inc., Greenwich, Conn.

[21] Appl. No.: 80,031

[22] Filed: Jun. 18, 1993

[51] Int. Cl.[5] ..... G03G 15/20

[52] U.S. Cl. ..... 355/285; 355/282; 355/289; 355/295

[58] Field of Search ..... 355/206, 282, 285, 286, 355/289, 290, 295, 284

[56] References Cited

U.S. PATENT DOCUMENTS

| | | | |
|---|---|---|---|
| 3,706,491 | 12/1972 | Furman et al. | 355/133 |
| 3,794,417 | 2/1974 | Machmer | 355/290 |
| 4,427,285 | 1/1984 | Stange | 355/288 |
| 4,719,489 | 1/1988 | Ohkubo et al. | 355/290 |
| 4,814,819 | 3/1989 | Torino et al. | 355/290 |
| 4,825,242 | 4/1989 | Elter | 355/285 X |
| 4,958,195 | 9/1990 | Firth et al. | 355/290 |
| 4,998,121 | 3/1991 | Koh et al. | 355/285 X |
| 5,196,895 | 3/1993 | Setoriyama et al. | 355/285 |
| 5,220,389 | 6/1993 | Kishimoto et al. | 355/285 |
| 5,241,159 | 8/1993 | Chatteriee et al. | 355/290 X |

FOREIGN PATENT DOCUMENTS 57-102676 6/1982 Japan .

*Primary Examiner*—Fred L. Braun

*Attorney, Agent, or Firm*—John A. Brady

[57] ABSTRACT

A printer for fusing images on sheets of at least three width size categories including small, medium, and large is operated by control through a microprocessor assigning −7 to full size sheets, +13 to small size sheets and +17 to envelopes. These are accumulated until the count reaches 127, at which the interpage gap is adjusted based on which of those three categories is being printed and which of the three categories will next be printed. This maximizes throughput without requiring a thicker fuser.

4 Claims, 1 Drawing Sheet

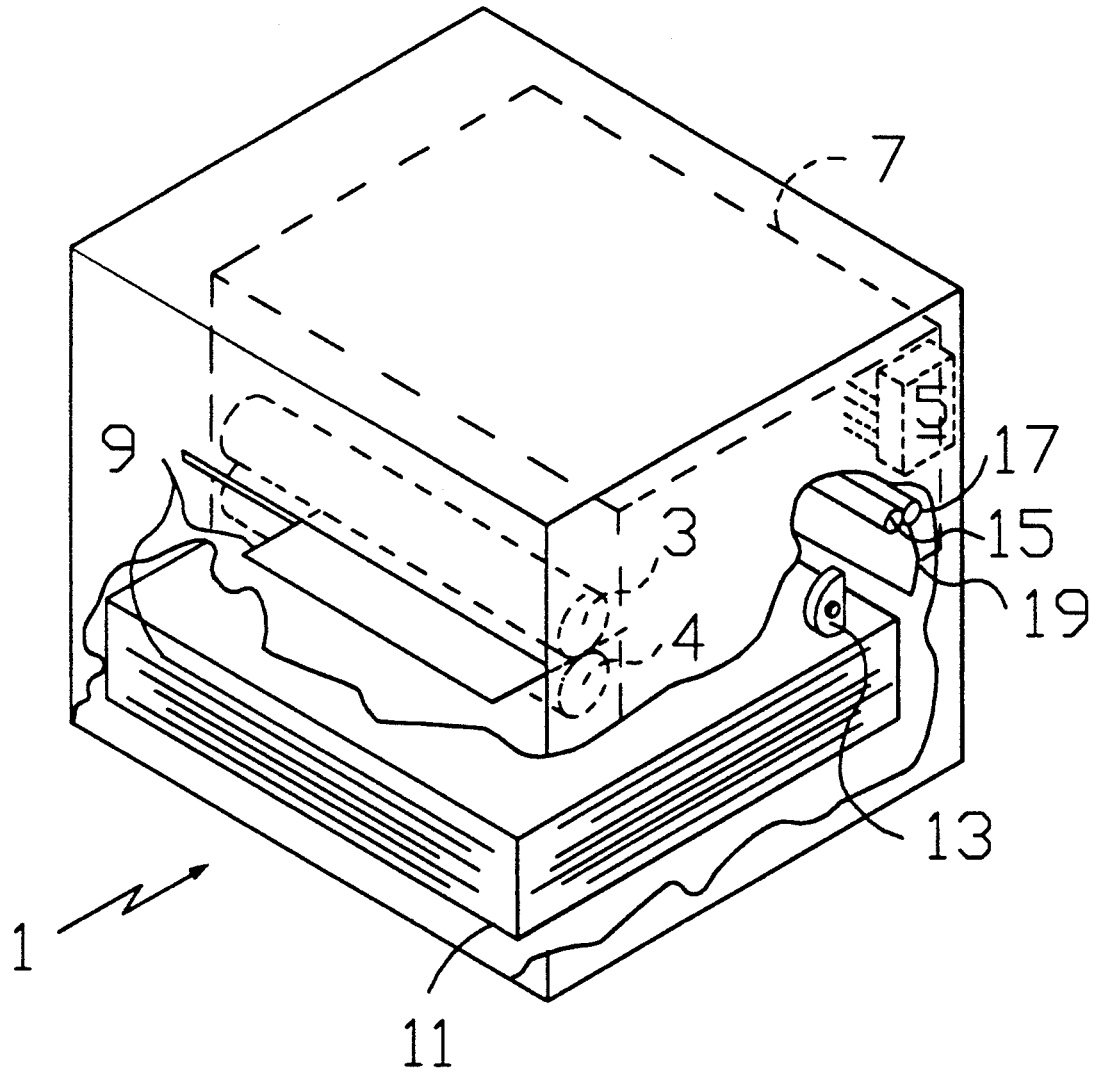
7
9
17
15
3
19
4
13
1
11

FUSER OVERHEAT CONTROL

TECHNICAL FIELD

This invention relates to imaging apparatus employing heaters to fix a toned image to paper or other substrate. More specifically, this invention relates to protecting such apparatus from overheating when the substrate is less than full size.

BACKGROUND OF THE INVENTION

An overheat potential exists by the feeding of narrow width medium (less than 8.5 inch, which is full size, standard paper in the United States) through a fuser in a paper feed system that uses one edge of the paper as a position margin, as opposed to the center of the paper. The thermal problem is caused by the accumulation of more thermal energy on that portion of the fuser hot roller which does not contact the paper when it is fed through the fuser. This can result in the fuser elements exceeding safe operating temperature (overheating), resulting in melting or other physical destruction of the imaging apparatus.

One existing prior art solution when the paper edge is the feeding boundary or reference is to maintain a count of envelopes and slow the throughput from 10 pages per minute (10 ppm) to 5 ppm by increasing the interpage gap when 15 envelopes are printed consecutively from the last idle condition. The envelope count is reset to zero if the printer is idle long enough for the fuser temperature, as measured by a thermocouple or other sensor, to drop to the standby temperature. Only printing of consecutive envelopes results in the slowing of throughput. Combinations of other substrates are printed at the maximum throughput of the printer.

Japanese patent 57-102676, dated Jun. 25, 1982, addresses the overheating by sensing the heating roller where the short-width paper does not extend and disconnecting the fuser heater when an predetermined upper limit is sensed.

Another existing prior art, in which the paper edge is the feeding boundary or reference, employs a sufficiently thick aluminum layer in the hot roller and slowing the rate for envelopes from 8 ppm to 6 ppm by enlarging the interpage gap (gap between two successively printed media). The thicker aluminum adds to cost and increase warm-up time.

DISCLOSURE OF THE INVENTION

A count is maintained in which a negative number (specifically −7) is assigned to full size sheets, an intermediate positive number (specifically 13) is assigned to smaller sheets (such as A5), and a larger positive number (specifically 17) is assigned to envelopes. Feeding of all the substrates is at the maximum speed for the imaging apparatus until the count reaches a predetermined maximum (specifically 127), at which time the interpage gap is adjusted based on which of the three categories is being printed and which of the three categories will next be printed. The count is reduced only by full size papers being printed, and the interpage gap is controlled until the count reaches a predetermined intermediate level (for example 100).

This permits throughput to be closely held to the maximum permitted by heat limitations by recognizing that heat is removed from the hotter portions of the fuser when printing on full size substrates. It avoids the cost of thicker aluminum in the roller and resulting slower warm-up.

BRIEF DESCRIPTION OF THE DRAWING

The details of this invention will be described in connection with the accompanying, partially-sectioned drawing which is illustrative of a microprocessor controlled printing apparatus in accordance with this invention.

BEST MODE FOR CARRYING OUT THE INVENTION

The fuser design used in the laser printer 1 of this invention is one where one side of the media being printed is against a reference edge in the printer. This means that for narrow media, such as envelopes, a portion of the hot roll 3 is being heated without the media being in contact with this portion of the hot roll. The portion of hot roll 3 not in contact with narrow media can be from 10 mm to 120 mm. The nonuniform heat removal from hot roll 3 having a back-up roller 4 by narrow media causes the surface of hot roll 3 not in contact with the narrow media to rise to temperatures that will damage the parts (detacks and bearings) in contact with hot roll 3. Control is by a microprocessor 5, which is standard in electronic printers. The software code used to control the fuser temperature must ensure that the non-uniformity of heat flow caused by narrow media is minimized to prevent melting of key fuser components. A portion of the software code is designed to control this heat distribution by adjusting the interpage gap on narrow media. Imaging apparatus 7 may be any system resulting in a toned image, for example that of a typical electrophotographic laser printer. Paper 9 is stacked in tray 11. A conventional D roller paper pick mechanism 13 pushes a single paper 9 from the top of tray 11. Guide 19 directs the paper to pinch rollers 15 and 17 which are continuously turning. Rollers 15 and 17 move paper 9 to imaging mechanism 7, where it ultimately exits at the front of printer 1 as shown. Paper 9 moves continuously in the same manner for printing on any size paper. Interpage gap is controlled by the time of each operation of pick mechanism 13. Printer 1 has multiple trays like tray 11 which may contain different sized sheets.

Because of the possibilities of 3 different media sizes: small (A5 sheets), full (8½"×11", B5, A4 and executive sheets) and envelopes and their respective impacts on interpage gap, along with the possibilities of alternating these together in any fashion, the algorithm of the invention employs history of what has been printed by accumulating "weighting" factors, relating to the type of pages printed so that multiple algorithms can be avoided, including their interactions with one another, and the boundary conditions associated with each. The algorithm assigns a value of plus 13 to the small paper sheets, a value of plus 17 to envelopes, and a value of minus 7 to full size sheets.

A one-byte counter is used to hold a running count of media weighting factors such that whenever a page (of whatever media size) is printed, its corresponding media weighting factor is added to the current count. The media weighting factors are given in the table at the end of this description, and can be either positive or negative.

At a point in time such that the counter reaches a maximum value (+127), a "Reduced Throughput flag" is set to indicate that the fuser is to the point where energy needs to be removed by reducing the media printing rate in order to limit the temperature of the hot roll not in contact with the narrow media being printed.

When the counter reaches its maximum value, the "Reduced Throughput Inter Page Gap" value is taken from a table based on the media size just printed (termed the "FIRST SHEET") and the next media size to be printed (termed the "SECOND SHEET"). As printing goes along, the page size just printed gets moved into the FIRST SHEET variable and the page size of the next sheet to be printed gets moved into the SECOND SHEET variable.

Typical examples when printer 1 is feeding at 3.33 in./sec. for 300 dots per inch printing are:

First Sheet Small; Second Sheet: Small then gap 16.7 inches; Full then gap 12.0 inches; and Envelope then gap 16.7 inches;

First Sheet Full; Second Sheet: Small then gap 11.33 inches; Full then gap 1.5 inches; and Envelope then gap 11.33 inches;

First Sheet Envelope; Second Sheet: Small then gap 30.5 inches; Full then gap 12.0 inches and Envelope then gap 30.5 inches.

Typical examples when printer 1 is feeding at 1.67 in/-sec for 600 dots per inch printing are:

First Sheet Small; Second Sheet: Small then gap 1.5 inches; Full then gap 6.0 inches; and Envelope then gap 1.5 inches;

First Sheet Full; Second Sheet: Small then gap 5.67 inches; Full then gap 1.5 inches; and Envelope then gap 5.67 inches;

First Sheet Envelope; Second Sheet: Small then gap 5.2 inches; Full then gap 6.0 inches; and Envelope then gap 5.2 inches.

These spacings may be predicted intuitively, but since they involve interaction of both heating and cooling on items of varying geometry, the final values are obtained experimentally. Thus, for a 1.67 in/sec operation, the gap between envelopes surprisingly is smaller than the gap between an envelope followed by a full sized sheet.

In each case the gap may be lengthened further for special purposes such as when the second sheet is a transparency made of material calling for lower temperatures.

Even when Reduced Throughput is active, printing of normal width paper (which is as wide as the fuser hot roller) is allowed to be at full throughput (the interpage gap corresponding to FIRST SHEET = Full and SECOND SHEET = Full is 1.5 inches which is full throughput).

Once the counter has reached its maximum value, it cannot be incremented any further and stays at the maximum value. At this point it can only be decremented by the full sheet weighing factor. When it dips below the maximum value, all weighing factors can be added or subtracted, until the maximum value is reached again or until a point termed the FULL THROUGHPUT THRESHOLD is reached. Reaching this threshold is achieved by more and more full-width sheets being printed, thereby, removing the required energy to get the fuser to the point where printing can be resumed at the rated speed. When the count reaches this threshold, the "Reduced Throughput" flag is cleared and the engine returns to normal throughput printing. Since this point is not the minimum value, the number of pages of narrow media printed before slowing down again is less than with a cold machine. However, this allows the machine to return to full speed quicker than if the absolute minimum point were considered the crossover. If the counter ever reaches the absolute minimum value (−128), it stays at this point until positive weighting factors are added to it. The media weighting factors were determined to maximize the printing rate of the media but not to exceed the safe operating temperature of the fuser parts in contact with the hot roll.

Microprocessor 5 initially acts on the size of the sheet fed from a tray 11 in printer 1 indicated by the sensing of a mechanical setting in the tray 11 or by operator input to printer 1. Preferably, the paper 9 first fed from a tray 11 is sensed and subsequent calculations for sheets from that tray are based on the sensed value, until the tray is removed. Alternatively, a single size sheet may be permanently assigned to a tray 11 and that size is acted upon during all operations. Other variations are clearly within the spirit and scope of this invention.

What is claimed is:

1. An imaging device for printing on sheets of at least three width size categories including small, medium, and large, comprising a fusing apparatus, means to count by adding a predetermined negative value for each large size sheet printed, by adding a predetermined first positive value for each medium size sheet printed, and by adding a predetermined second positive value larger than said first value for each small size sheet printed, and means operative when said count reaches a predetermined value, to adjust the intermedia gap to said fusing apparatus of a sheet to be fixed dependent upon the said category of the sheet being printed prior to said sheet to be fixed and the said category of said sheet to be fixed.

2. The imaging device of claim 1 in which said small category includes envelopes.

3. The imaging device of claim 2 in which said means to adjust becomes inoperative when said count reaches a predetermined count more than zero.

4. The imaging device of claim 1 in which said means to adjust becomes inoperative when said count reaches a predetermined count more than zero.

* * * * *